United States Patent [19]

Morris, Jr.

[11] Patent Number: 4,895,310

[45] Date of Patent: Jan. 23, 1990

[54] ICE BIN DISCHARGE MECHANISM FOR UNIFORM SIZE ICE

[76] Inventor: William F. Morris, Jr., P.O. Box 1046, Raleigh, N.C. 27602-1046

[21] Appl. No.: 307,532

[22] Filed: Feb. 8, 1989

[51] Int. Cl.[4] ..... B02C 11/02

[52] U.S. Cl. ..... 241/200; 241/280; 241/DIG. 17

[58] Field of Search ..... 241/200, 280, DIG. 17

[56] References Cited

U.S. PATENT DOCUMENTS

| | | | |
|---|---|---|---|
| 1,546,242 | 7/1925 | Keith | 241/DIG. 17 X |
| 2,435,030 | 1/1948 | Brady | 241/DIG. 17 X |
| 3,175,595 | 3/1965 | Coutts | 241/200 X |
| 3,208,491 | 9/1965 | Bliss | 241/280 X |

FOREIGN PATENT DOCUMENTS

| | | | |
|---|---|---|---|
| 549450 | 9/1975 | U.S.S.R. | 241/200 |
| 212401 | 3/1924 | United Kingdom | 241/200 |

*Primary Examiner*—Timothy V. Eley
*Attorney, Agent, or Firm*—Mason, Fenwick & Lawrence

[57] ABSTRACT

An ice storage bin and discharge apparatus for discharge of uniform size ice to an outlet station for bagging or other use, including an ice bin in the form of an elongated insulated storage receptacle for containing a mass of ice, and endless floor level conveyor adjacent and overlying the bottom wall spanning the length and width thereof defining an upper flight for advancing the mass of ice toward a discharge end wall of the bin. A first drive is provided for driving the floor level endless conveyor at a predetermined speed, and an ice shearing mechanism is provided at the discharge end wall comprising a plurality of ice shaving blades positioned to lie in a vertical cutting path extending above and aligned with a transverse discharge conveyor with the shear blades collectively transversely spanning substantially the width of the bin at plural levels above the discharge conveyor. A second drives moves the shear blades at a constant predetermined speed substantially through the height of the bin across the face of the ice mass being advanced toward the discharge end wall by the floor level conveyor to shear a selected thickness of ice particles off of the face of the ice mass to fall into the working zone of the discharge conveyor.

12 Claims, 2 Drawing Sheets

ICE BIN DISCHARGE MECHANISM FOR UNIFORM SIZE ICE

BACKGROUND AND OBJECTS OF THE INVENTION

The present invention relates in general to ice handling apparatus, and more particularly to a combined ice storage bin and discharge apparatus for storing a mass of fragmented ice and moving it toward one end of the storage apparatus together with a discharge mechanism therefor.

Heretofore, various types of ice storage devices have been provided for storing a large quantity of ice and discharge of the ice for bagging or for delivery to a use station. One type of such apparatus heretofore used has been the type known as a "Kasten Transfer Bin", of the type sold by Ice Plant Equipment, Co., of Philadelphia, Pa, wherein a generally rectangular storage bin or boxlike container is provided with floor chains to move a mass of ice toward one end of the bin, and a series of several high speed rotating beater bars with rotating arms are provided at the end toward which the mass of ice is advanced to beat at the face of the advancing mass of ice. The self-unloading Kasten Transfer Bin is lined with a high density polyethylene material and includes what are referred to as "blade-tooth beaters" to break lose ice fragments which fall into an auger discharge conveyor for transfer into the bags. It has been found, however, that the beating action occurring in this Kasten Transfer Bin creates a great amount of "snow" or "fines" from the ice, which is of little use and gives no uniformity in size of the ice. The rapidly rotating bars are also considered a safety hazard and give an uncontrolled flow rate.

The amount of "fines" or "snow" generated is of considerable importance, since they are difficult to handle, often cause packing or jamming in conveying or handling systems, and must be screened out before bagging if the ice is to be bagged for sale. Such screening may represent a loss of up to about 30% in some of the bin designs.

Other designs of bins which have been widely used are of the top rake unloader type, wherein the ice mass in the boxlike container does not move, but a rake drags across the top of the ice mass and brings the ice on top of the pile to one end of the bin for unloading. This design is quite complicated since the up and down moment of the rake must be positively controlled by cables to control the rate of discharge as the bin is unloading and must also be controlled in a way to prevent the rake from being buried under the ice when the bin is filling. This produces severe design complications. The amount of snow created by this system is similar to that produced in the Kasten Transfer Bin type of apparatus, and in addition the machinery being located on top of the ice pile is such that the raking occurs at the top of the pile only, and frequently the bottom half or so of the ice mass freezes into a solid mass which is unusable. When such ice mass freezing occurs, the bin must be shut down to melt or dig out this bottom part. Sanitation is also a severe problem in this type of bin since all moving and wearing parts as well as any repair functions must be done on top of the ice mass and any leakage, dripping or bearing particles fall directly into the ice and cause ice contamination.

An object of the present invention is the provision of a novel ice storage bin and discharge mechanism for discharge of uniform size ice, for use in bagging and similar use operations, wherein movement of the ice mass toward the discharge end is achieved at a constant rate and cutter blades are provided which operate at constant speed, taking a constant bite or cut off the face of the advancing ice mass at a slow and controlled rate, resulting in ice particles of constant size and minimizing production of fines.

Another object of the present invention is the provision of a novel ice storage bin and discharge mechanism as described in the preceding paragraph, wherein means are provided for moving the mass of fragmented ice toward one end of the storage container at a controlled rate into a set of vertical knives moving completely across the face of the advancing mass at a controlled rate, so as to shear a fixed thickness of ice particles off the face of the ice mass with a minimum of fines or snow, together with a screw conveyor means for delivering the sheared ice particles to a desired location for immediate use or bagging.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
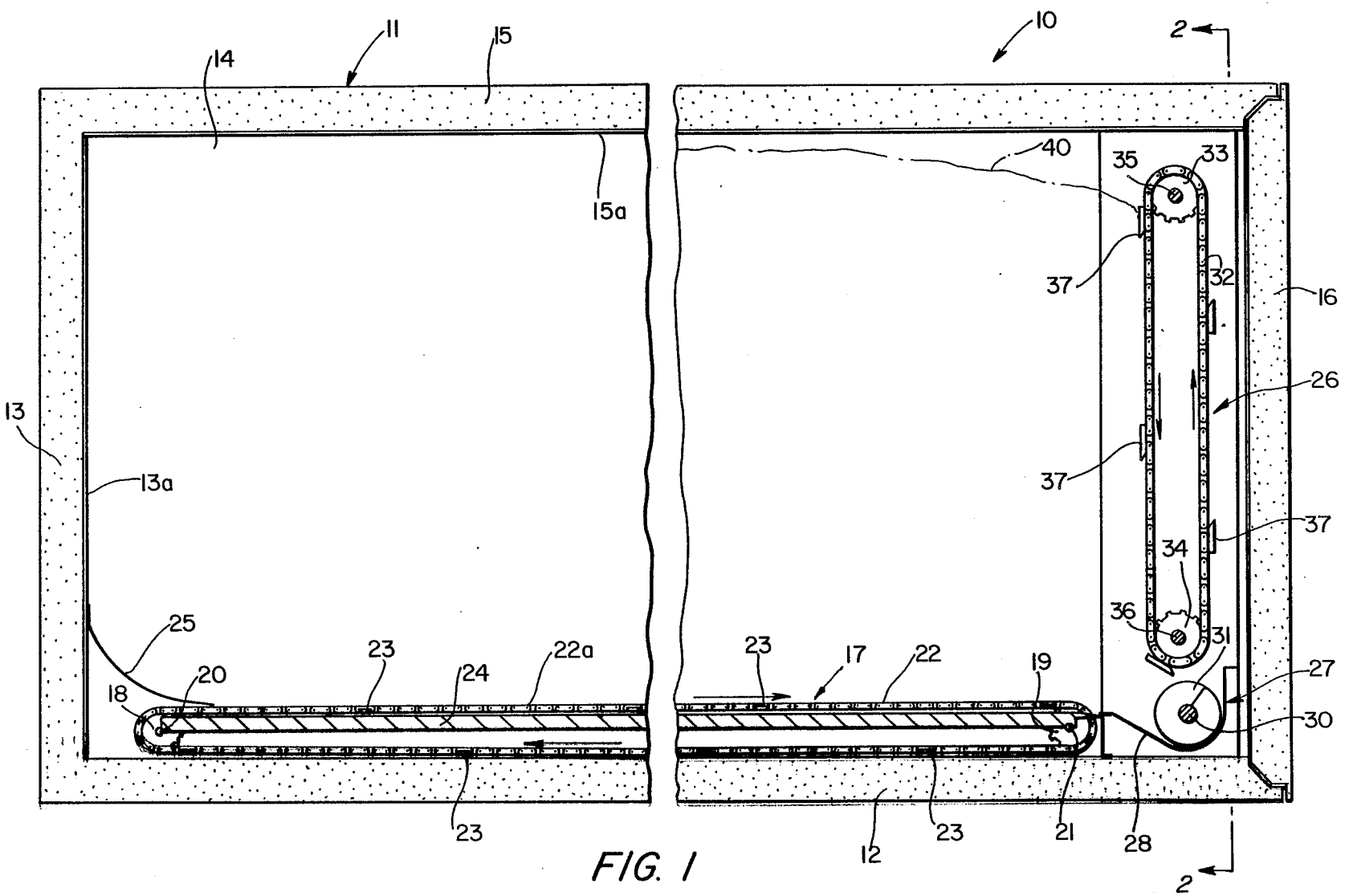
FIG. 1 is a vertical longitudinal section view through an ice storage bin and discharge mechanism embodying the present invention.

Referring to the drawings, wherein like reference characters designate corresponding parts throughout the several figures, the ice bin and discharge mechanism for storing and discharging uniform size ice, embodying the present invention, is indicated generally by the reference character 10, and comprises a horizontally elongated box-shaped insulated ice bin 11 having a bottom wall or floor 12, a first end wall 13, side walls 14, and a top wall or ceiling 15, formed for example of channel framing members and insulating filler of conventional construction, defining a box-shaped bin which in the illustrated example is 8 feet high by 8 feet wide and about 40 feet long. The bottom end and side walls 12, 13, 14 are lined with high density polyethylene, forming inner walls or surface layers, indicated at 13*a*, 14*a* and 15*a*, for example formed of a 3/16th inch thick white high density polyethylene layer. The sealing may be formed, if desired, of other low thermal conductive material. The framework for the bin walls, in the illustrated embodiment, is formed of galvanized channels welded together to provide a structure of appropriate strength. The end of the bin opposite the vertical end wall 13 provides an access opening which is normally closed by an insulated ice bin door 16, formed in a manner similar to the end wall 13 and side walls 14 and having a high density polyethylene liner forming the inner surface 16*a* thereof.

Extending along the floor or bottom wall 12 of the ice bin substantially spanning the width and length of the chamber defined thereby is an endless drive floor chain or roller chain assembly 17 formed of sprockets 18, 19 having associated shafts 20, 21 journaled in the side walls of the bin and endless chains 22 trained about the sprockets 18, 19, and having stainless steel attachment bars 23 transversely connecting the chains 22. Preferably, the sprockets 18, 19 are nickel plated sprockets, and the chains 22 and attachment bars 23 are of stainless steel, and the upper flight 22*a* of the base drive chain conveyor formed by the chains 22 and bars 23 extends in a horizontal plane immediately above the drive chain floor 24, which may also be formed of high density polyethylene. An arcuately curved ice shield 25 secured to the end wall 13, which may also be formed of white high density polyethylene, overlies the sprocket and shaft assembly 18, 20 and terminates with a free edge immediately above the upper flight of the drive chains 22.

Figure 3:
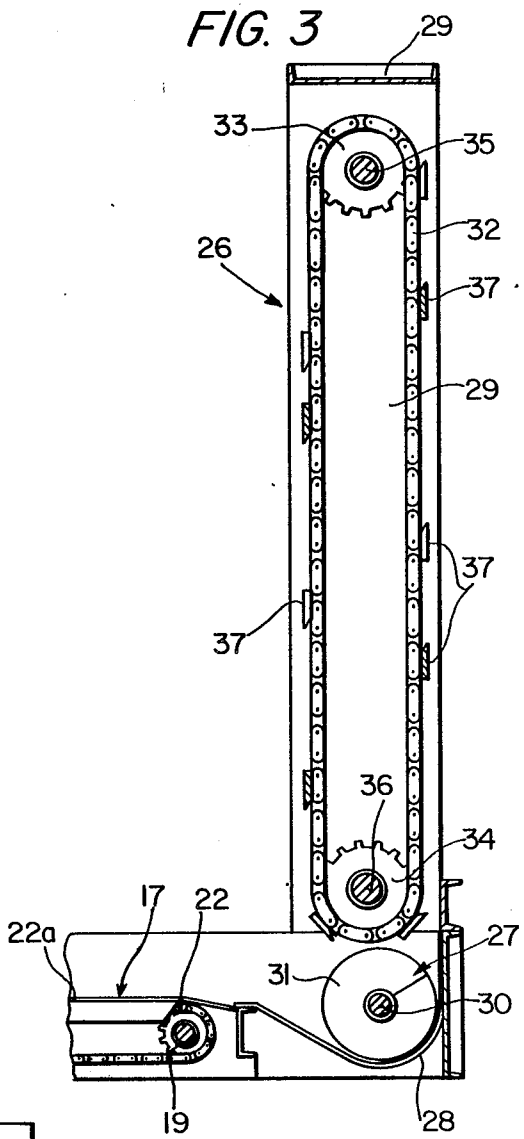
FIG. 3 is a section view of the ice cutter roller chain and bar assembly and adjacent components of the discharge conveyor auger and adjacent end of the floor drive roller chain assembly, taken along the section plane 3–3 of FIG. 2.
Figure 2:
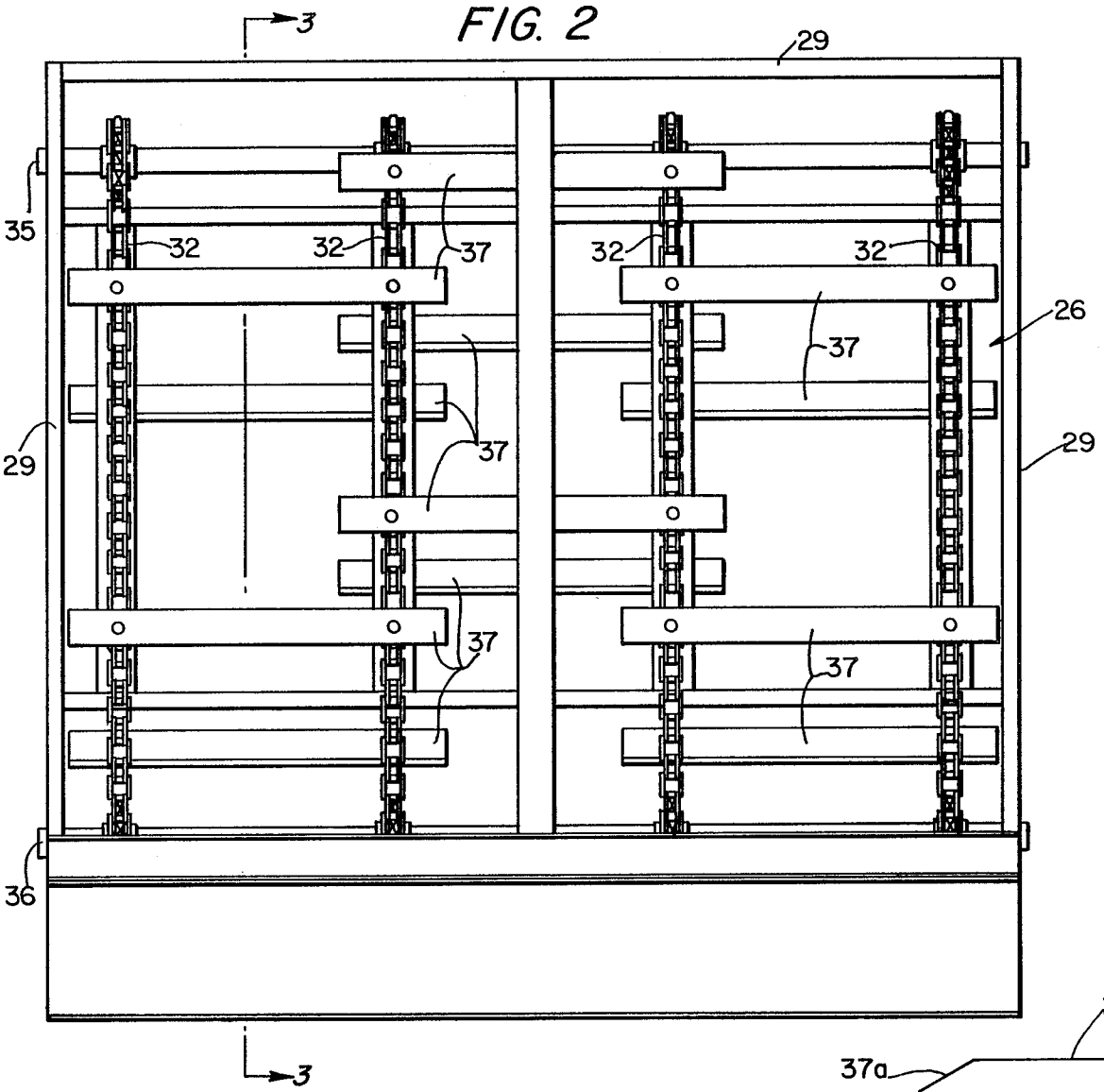
FIG. 2 is a vertical transverse section view illustrating details of the ice cutter bar mechanism, taken along the section plane 2–2 of FIG. 1.
Figure 4:
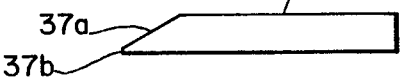
FIG. 4 is an enlarged detailed section view of one of the ice cutter bars.

An ice cutter bar assembly 26 and outlet trough and auger assembly 27 are provided immediately inwardly of the ice bin door 16 as shown. The trough portion of the trough and auger assembly is formed of stainless steel and is secured at its opposite ends to vertical frame members 29, and is shaped to define an upwardly facing concave trough 28 having a curved portion substantially concentric with the shaft 30 of the auger 31 located adjacent a discharge end of the base drive roller chain and bar assembly 17 to receive fragmented ice cut from the face of the ice mass supported on and advanced by the floor chain system 17. The ice cutter bar assembly 26 is formed of endless stainless steel ice cutter roller chains 32 trained about nickel plated sprockets 33, 34 on shafts 35, 36 also supported by the framework 29, and support stainless steel ice cutter bars or blade members 37, shown or particularly in FIGS. 2, 3 and 4. The stainless steel ice cutter bars or blades 37 may be blades formed from stainless steel flat bar stock ½ high and 4 inches wide of a length to substantially span the interior width of the chamber defined by the bin walls, and having a 45 bevel cut as indicated at 37*a* beginning 1/16ht inch above the bottom face of the flat bar stock, providing a 1/16th inch narrow edge 37*b* adjoining the beveled inclined surface 37*a*.

The floor chain system 17 and the cutter blade system 26 re both driven at a constant rate of speed, by drives from conventional drive means applied to one of the sprocket shafts, for example, a shaft 21, and to shaft 36 and shaft 30 of the cutter blade system 26 and the conveyor auger 31, so that the blades or cutter bars 37 take a constant "bite" or "cut" off the face of the advancing ice mass, indicated generally at 40, at a slow and controlled rate which results in ice particles of constant size and with practically no fines.

The arrangement is such that the present invention provides a positive means of moving the mass of fragmented ice stored in the bin and supported on the floor chain system 27 toward the door end of the box or bin at a controlled rate into the set of vertically arranged and vertically moving knives or cutter blades formed by the stainless steel cutter bars 37 moving completely across the face of the advancing ice mass also at a controlled rate so as to shear a fixed thickness of ice particles off the face of the ice mass with a minimum of fines or snow. The sheared ice particles then fall into the screw conveyor system 27 directly below the cutting blades or bars 37 to be conveyed laterally through an opening aligned with the auger 31 to any desired point for immediate use or bagging. In one satisfactory example, for a 40 foot long ice bin, the floor chain system 17 may be driven at a speed such as to advance the chain 5 inches per minute for 400 CB per minute or 10 inches per minute for 800CB per minute, with the cutter bar system 26 having a shaft rotation of 17 ¼ rpm producing a chain speed of 35 feet per minute. For example, with a chain speed of about 35 feet per minute and a total chain length of about 12 feet for the cutter chain system, and a blade spacing of about 29 inches between successive blades 37, the depth of the ice slice produced at a floor chain sheep of 10 inches per minute would be about 0.72 inches.

It will be apparent that speeding up or slowing down the rate of speed of the cutter blades will result in a smaller or larger ice pieces of fragments respectively, but as long as both the speed of the advancing ice mass (which is regulated by the speed of the floor chain system) nd the speed of the cutter blades are constant, the size of ice particles will be substantially constant, whether large or small, and thus the size can be adjusted by adjusting these speeds.

I claim:

1. An ice bin and discharge apparatus for discharge of uniform size ice to an outlet station for bagging or other use, comprising an ice bin in the form of an elongated insulated storage receptacle having insulated vertical side and end walls and horizontal bottom and top walls for containing a mass of ice, one of said end walls defining a discharge end wall, a base conveyor assembly adjacent and overlying the bottom wall spanning the length and width thereof and having a floor level conveyor means defining an upwardly facing flight having means for advancing the mass of ice toward said discharge end wall, first drive means for driving the floor level conveyor means at a predetermined speed, a transverse discharge conveyor inwardly adjacent the lower portion of said discharge end wall for conveying ice fragments conveyed thereto transversely of the bin through a discharge opening to said outlet station, an ice shearing mechanism at said discharge end wall comprising a plurality of thin elongated ice-shaving shearing blades positioned to lie in a vertical cutting path extending above and aligned with said discharge conveyor with said shearing blades collectively transversely spanning substantially the width of the bin at plural levels above the discharge conveyor, and second drive means for moving said shearing blades at a constant predetermined speed substantially through the height of the bin across the face of the ice mass being advanced toward said discharge end wall by said floor level conveyor means to shear a selected thickness of ice particles of the confronting face of the ice mass to fall into the working zone of said discharge conveyor, said shearing blades being thin blade members of substantially rectangular cross-section having a cutting leading edge for shearing off ice particles from the face of the ice mass and the thin blades being of generally planiform configuration and arranged substantially in vertical planes paralleling said discharge end wall.

2. An ice storage bin and discharge apparatus as defined in claim 1, wherein said ice shearing mechanism comprises sprocket means mounted inwardly adjacent the upper and lower portions of said discharge end wall for rotation about parallel horizontal axes and a plurality of endless chains trained about said sprocket means having said shearing blades fixed thereon, the shearing blades being elongated blade members extending transversely between pairs of said chains with their longitudinal axes extending transversely horizontally and located in a vertical shearing plane defined by said chains speed inwardly and disposed parallel to said discharge end wall.

3. An ice storage bin and discharge apparatus as defined in claim 2, wherein said bottom level conveyor assembly comprises rotatable sprocket means inwardly adjacent each of said end walls located immediately above said bottom wall an endless chain strained about said sprocket means defining said upwardly facing flight of said floor level conveyor means, said chains having elongated attachment bars secured thereto collectively transversely spanning the bin to assist advancement of the ice mass toward said discharge end, and means defining an elongated substantially planiform drive chain floor immediately underlying said upper flight of said floor level conveyor means providing a low friction supporting floor for the ice mass.

4. An ice storage bin and discharge apparatus as defined in claim 2, wherein said pairs of endless chains having said shearing blades fixed thereon are arranged in at least three transversely spaced plural blade-and-chain subassemblies each comprising a pair of endless chains trained about said sprocket means and carrying a plurality of said shearing blades arranged with their longitudinal axes extending transversely in horizontal parallelism between the associated chains and defining a respective vertical shearing plane subsection, the shearing plane subsections defined thereby collectively transversely spanning the height and width of the bin with one of said subsections lying centrally between the two other subsections laterally flanking the same, the blades of the center-most subsection adjacent there opposite ends overlapping adjacent end portions of the shearing blades of the respective laterally flanking subsections and being spaced vertically therefrom whereby overlapping portions of the shearing blades traverse the same region along pair of vertically extending overlap zones of the vertical cutting path.

5. An ice storage bin and discharge apparatus as defined in claim 4, wherein said shearing blades along their longitudinal axes forming each of said subsections are of the same length whereby the shearing zones traversed by the blades of each subsection are of the same width.

6. An ice storage bin and discharge apparatus as defined in claim 1, wherein said bottom level conveyor assembly comprises rotatable sprocket means inwardly adjacent each of said end walls located immediately above said bottom wall an endless chains trained about said sprocket means defining said upwardly facing flight of said floor level conveyor means, said chains having elongated attachment bars secured thereto collectively transversely spanning the bin to assist advancement of the ice mass toward said discharge end, and means defining an elongated substantially planiform drive chain floor immediately underlying said upper flight of said floor level conveyor means providing a low friction supporting floor for the ice mass.

7. An ice storage bin and discharge apparatus as defined in claim 6, wherein said pairs of endless chains having said shearing blades fixed thereon are arranged in at least three transversely spaced plural blade-and-chain subassemblies each comprising a pair of endless chains trained about said sprocket means and carrying a plurality of said shearing blades arranged with their longitudinal axes extending transversely in horizontal parallelism between the associated chins nd in horizontal parallelism between the associated chains nd defining a respective vertical shearing plane subsection, the shearing plane subsections defined thereby collectively transversely spanning the height and width of the bin with one of said subsections lying centrally between the two other subsections laterally flanking the same, the blades of the center-most subsection adjacent their opposite ends overlapping adjacent end portion of the shearing blades of the respective laterally flanking subsections and being spaced vertically therefrom whereby overlapping portions of the shearing blades traverse the same region along a pair of vertically extending overlap zones of the vertical cutting path.

8. An ice storage bin and discharge apparatus as defined in claim 7, wherein said shearing blades along their longitudinal axes forming each of said subsections are of the same length whereby the shearing zones traversed by the blades of each subsection are of the same width.

9. An ice storage bin nd discharge apparatus for discharge of uniform size ice to an outlet station for bagging or other use, comprising an ice bin in the form of an elongated insulated storage receptacle having insulated vertical side and ends walls and horizontal bottom nd top walls for containing mass of ice, one of said end walls defining a discharge end wall, abase conveyor assembly adjacent and overlying the bottom wall spanning the length nd width-thereof and having a floor level conveyor means defining an upwardly facing flight having means for advancing the mass of ice toward said discharge end wall, first drive means for driving the floor level conveyor means at a predetermined speed, a transverse discharge conveyor inwardly adjacent the lower portion of said discharge end wall for conveying ice fragments conveyed thereto transversely of the bin through a discharge opening to said outlet station, an ice shearing mechanism at aid discharge end wall comprising a plurality of thin-ice-shaving shearing blade positioned to lie in a vertical cutting path extending above and aligned with said discharge conveyor with said shearing blades collectively transversely spanning substantially the width f the bin at plural levels above the discharge conveyor, and second drive means for moving said shearing blades t a constant predetermined speed substantially through the height of the bin across the face of the ice mass being advance toward said discharge end wall by said floor level conveyor means to shear a selected thickness of ice particles off the confronting face of the ice mass to fall into the working zone of said discharge conveyor, said ice shearing mechanism comprising sprocket means mounted inwardly adjacent the upper and lower portions of said discharge end wall for rotation about parallel horizontal axes and a plurality of endless chains trained about said sprocket means having said shearing blades fixed thereon, the shearing blades being elongated blade members extending transversely between pairs of said chains with their longitudinal axes extending transversely horizontally and located in a vertical shearing plane defined by said chins spaced inwardly nd disposed parallel to said discharge end wall.

10. An ice storage bin nd discharge apparatus as defined in claim 9, wherein said pairs of endless chains having said shearing blades fixed thereon are arranged in at least three transversely spaced plural blade-and-chain subassemblies each comprising a pair of endless chains trained about said sprocket means and carrying a plurality of said shearing blades arranged with their longitudinal axes extending transversely in horizontal parallelism between the associated chains and defining a respective vertical shearing plane subsection, the shearing plane subsections defined thereby collectively transversely spanning the height and width of the bin with one of said subsections lying centrally between the two other subsections laterally flanking the same, the blades of the center-most subsection adjacent their opposite ends overlapping adjacent end portions of the shearing blades of the respective laterally flanking subsections and being spaced vertically therefrom whereby overlapping portions of the shearing blades traverse the same region along a pair of vertically extending overlap zones of the vertical cutting path.

11. An ice storage bin and discharge apparatus as defined in claim 10, wherein said shearing blades along their longitudinal axes forming each of said subsections are of the same length whereby the shearing zones traversed by the blades of each subsection are of the same width.

12. An ice storage bin and discharge apparatus as defined in claim 9, wherein said bottom level conveyor assembly comprises rotatable sprocket means inwardly adjacent each of said end walls located immediately above said bottom wall an endless chain strained about said sprocket means defining said upwardly facing flight of said floor level conveyor means, said chains having elongated attachment bars secured thereto collectively transversely spanning the bin to assist advancement of the ice mass toward said discharge end, and means defining an elongated substantially planiform drive chain floor immediately underlying said upper flight of said floor level conveyor means providing a low friction supporting floor for the ice mass.

* * * * *